US005097614A

United States Patent [19]

Strong

[11] Patent Number: 5,097,614

[45] Date of Patent: Mar. 24, 1992

[54] RIOT GUN

[76] Inventor: B. Gene Strong, Rte. 2, Box 861, New Iberia, La. 70560

[21] Appl. No.: 517,310

[22] Filed: May 1, 1990

[51] Int. Cl.[5] ..... F41A 1/06; F41A 13/08; F41A 21/28

[52] U.S. Cl. ..... 42/76.01; 89/14.05

[58] Field of Search ..... 42/76.01; 89/1.3, 1.35, 89/14.05

[56] References Cited

U.S. PATENT DOCUMENTS

| | | | |
|---|---|---|---|
| 819,834 | 5/1906 | Zalinski | 89/14.05 |
| 2,383,087 | 8/1945 | Shaffer | 89/1.3 |
| 3,380,344 | 4/1968 | Bucklisch et al. | 89/1.3 |
| 3,491,650 | 1/1970 | Rohr | 42/76.01 |
| 3,611,867 | 10/1971 | Silsby | 42/76.01 |
| 3,724,114 | 4/1973 | Jones et al. | 42/76.01 |
| 3,733,727 | 5/1973 | Jones et al. | 42/76.01 |

*Primary Examiner*—Richard W. Wendtland

[57] ABSTRACT

This invention relates to a variable velocity riot gun designed to give the individual using it control over the velocity of the projectile such that he can effect a sub-lethal attack of projectile impact upon his opponent at will on a shot by shot basis at a variety of target distances and hardness. This is achieved by a gun design including two barrels; a main barrel and a vent barrel. The vent barrel slides forward and back to open and close vents in the main barrel. For minimum projectile velocity the vent barrel is disposed fully to the rear with all vents open. When the vent barrel is disposed forward, all vents are closed to produce maximum projectile velocity.

4 Claims, 5 Drawing Sheets

RIOT GUN

FIELD OF THE INVENTION

This invention relates to the field of variable velocity firearms.

BACKGROUND OF THE INVENTION

The military and police forces of the world today are faced with the problem of dealing with hostile civilians in a non-lethal manner. Hand to hand combat is not safe for the foot soldier and tear gas has its own set of disadvantages. Plastic training bullets, lead-shot filled bags and rubber shotgun slugs or pellets are only good at a given distance. When the projectiles from currently available weapons are fired, the operator has no control over how fast it will travel on a shot-by-shot basis.

This presents a need for a variable velocity firearm which will allow the user to either manually or automatically control the velocity of the projectile, based on target distance and target hardness. Often it is desirable to injure, subdue or cause pain to an opponent rather than kill him as a means of forceful control. The target range is often or usually not within the control of the operator, so that if a target is close or soft the projectile will totally penetrate said target. On the other hand, the next shot may be at a greater distance, and if the projectile lacks adequate velocity it will have little accuracy or impact upon the target.

The variable velocity firearm is designed to give the individual using it control over the velocity of the projectile such that he can effect a sublethal attack or projectile impact upon his opponent at will on a shot-by-shot basis at a variety of target distances and consistancies.

SUMMARY OF THE INVENTION

A principal object of the invention is a new and improved variable velocity firearm wherein the velocity of the projectile may be varied at will. The firearm operates by allowing the user either manually or automatically ventoff, in various selected amounts, the explosive gasses which propel the projectile down the barrel of the gun.

BRIEF DESCRIPTION OF THE DRAWINGS

The invention will be more readily understood by referring to the several figures of the drawings.

DETAILED DESCRIPTION OF THE PREFERRED EMBODIMENT

Figure 1:
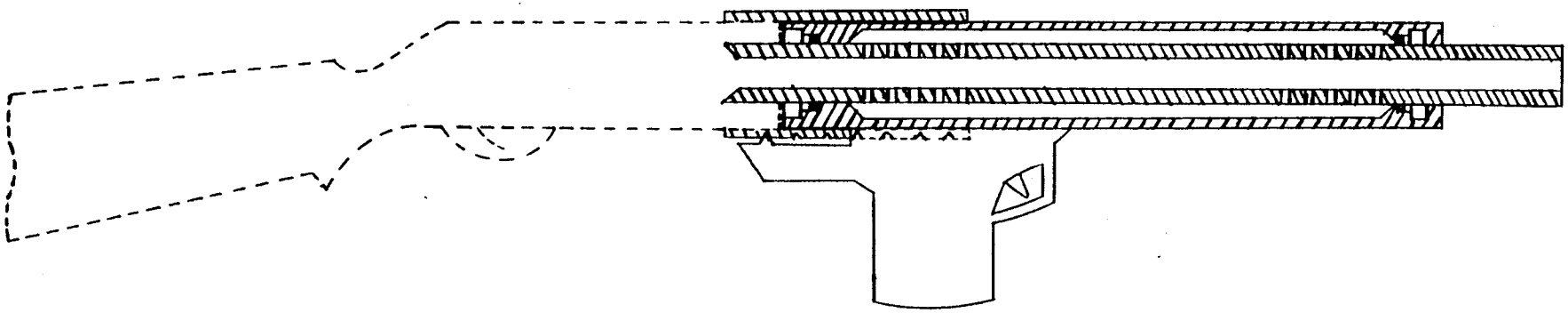
FIG. 1 is a view in cross section of the variable firearm.
Figure 2:
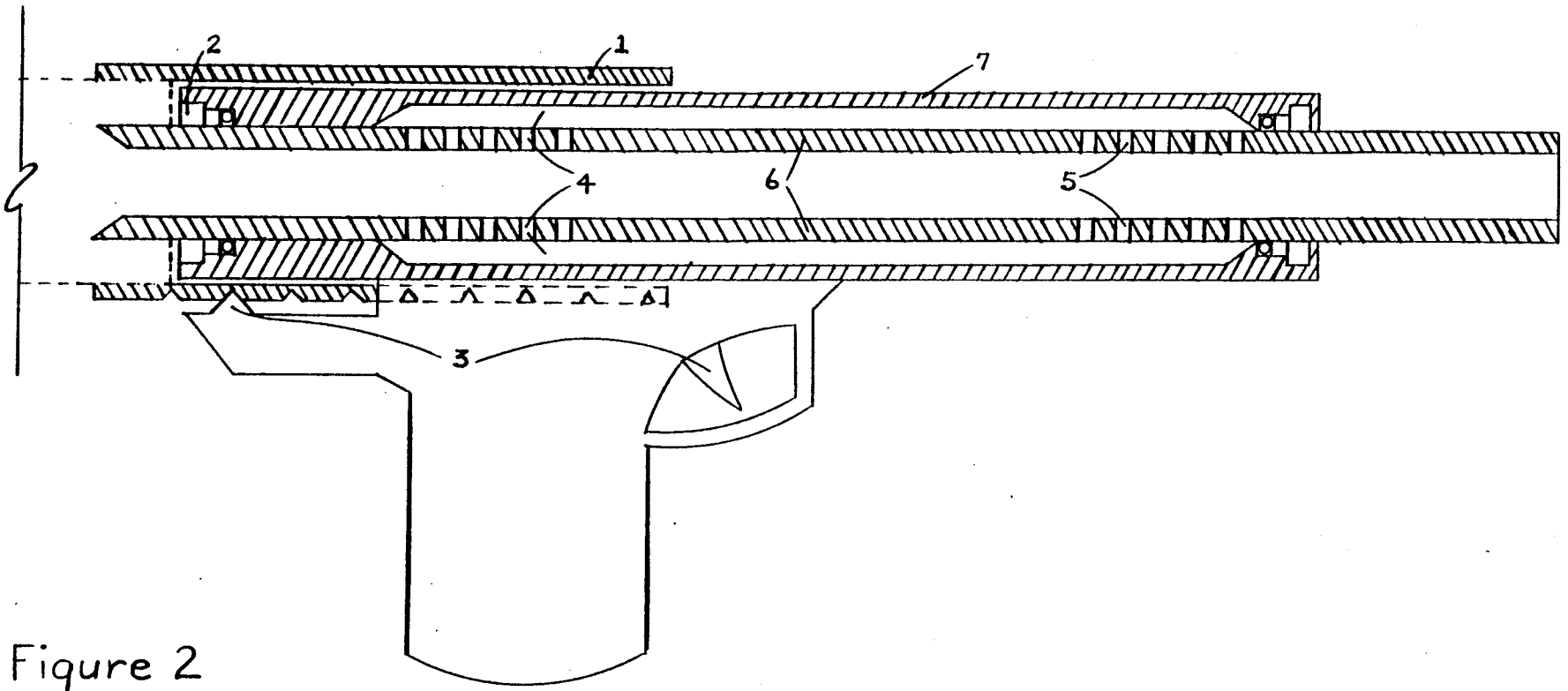
FIG. 2 is a more detailed view referring to the parts of the gun by legends.
Figure 3:
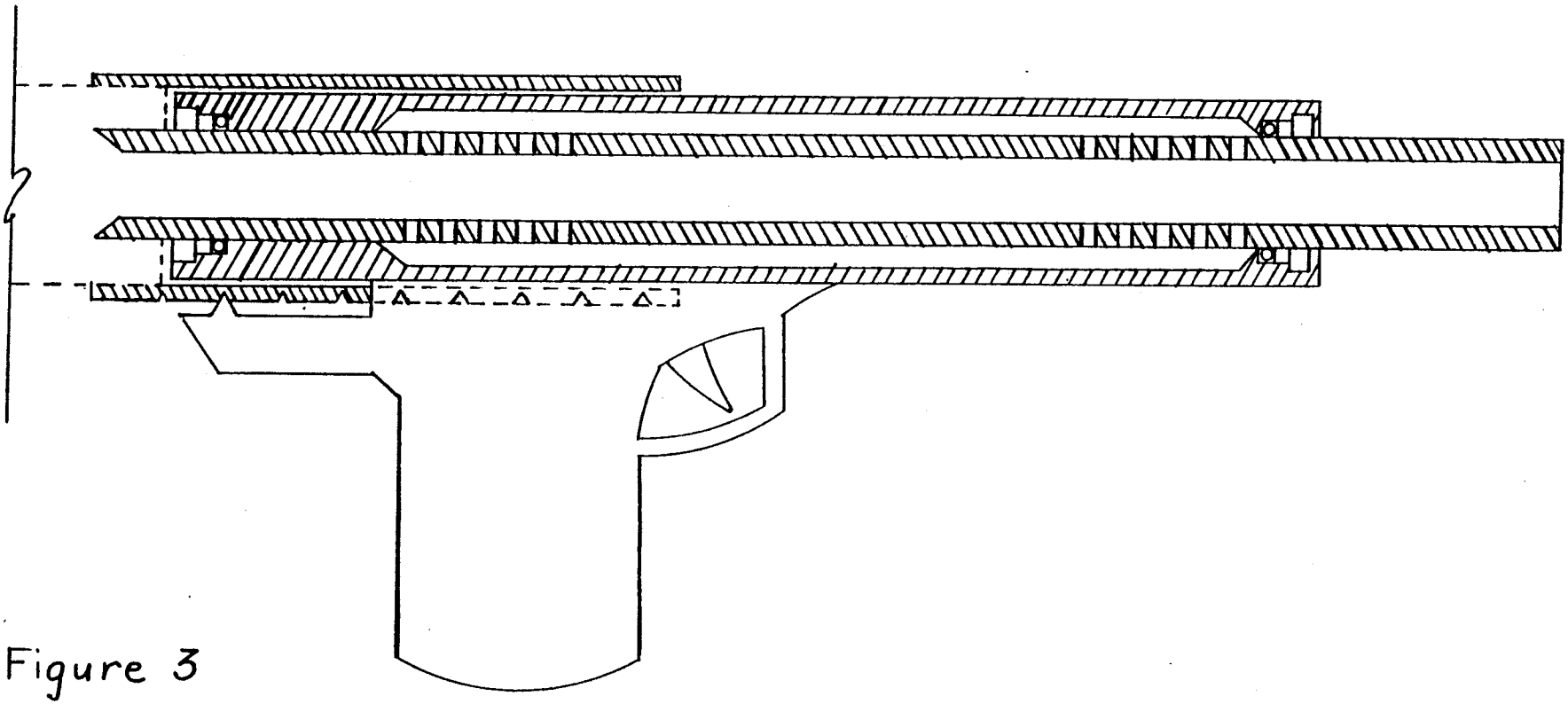
FIG. 3 is a view in cross section of the two barrels disposed for minimum pressure.
Figure 4:
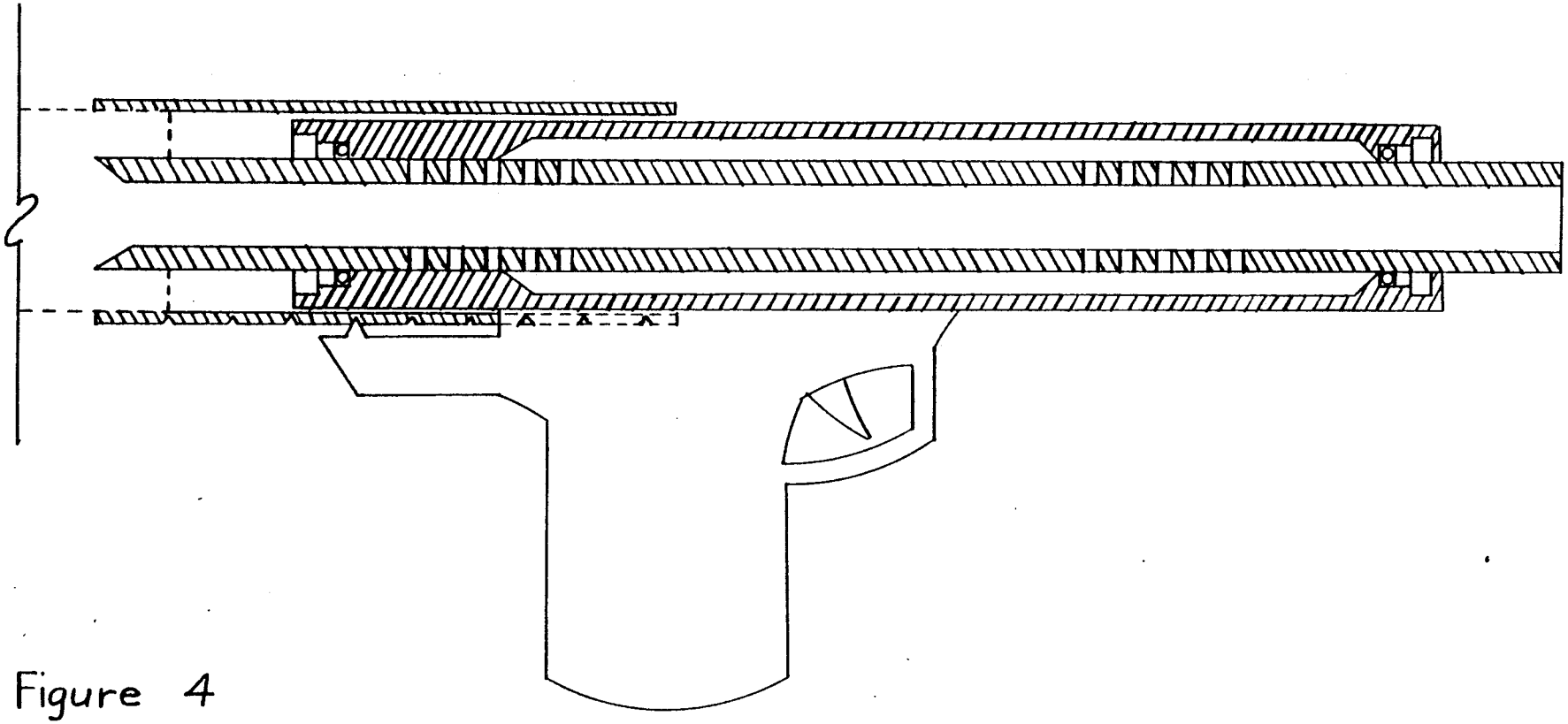
FIG. 4 is a view of the barrels with the vents partially opened for medium velocity.
Figure 5:
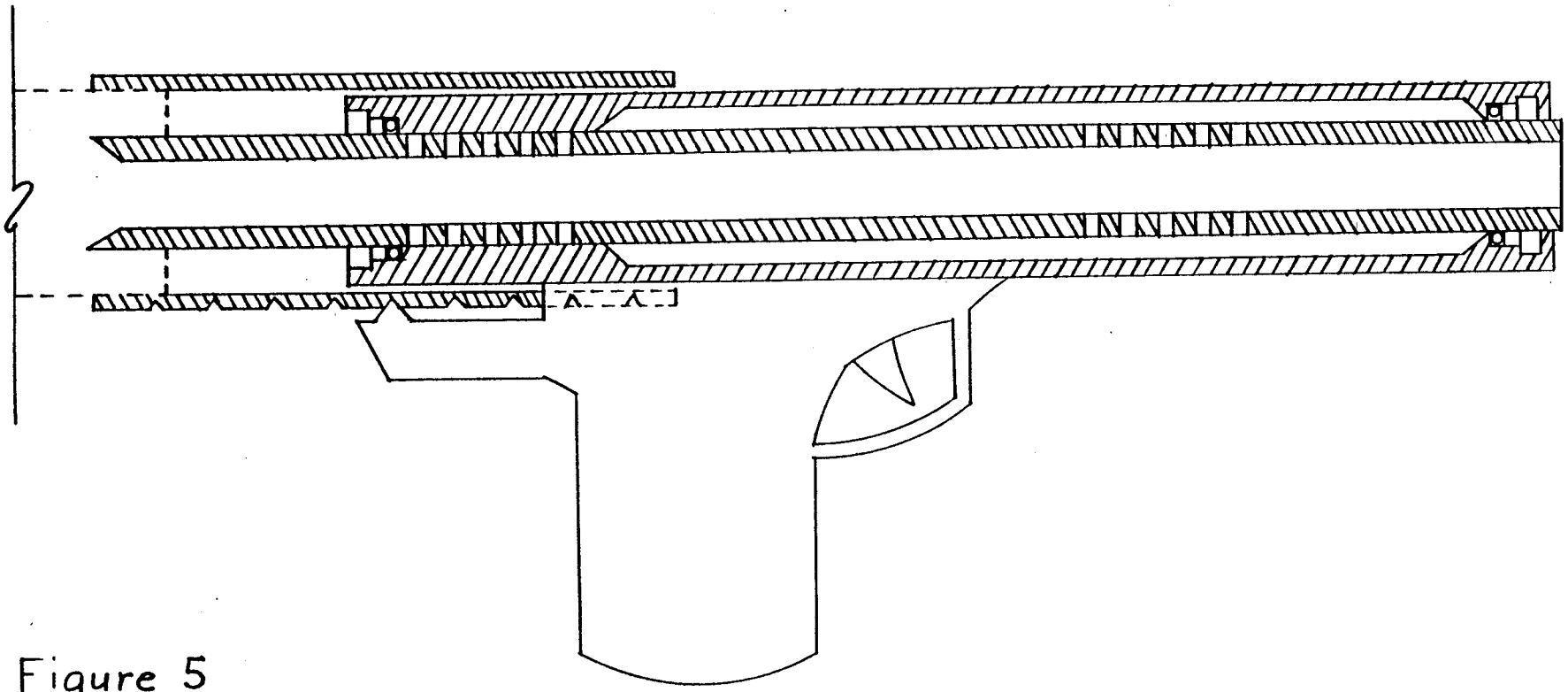
FIG. 5 is a view with all vents closed for maximum velocity.

The invention is more readily understood by assigning numbers to the various parts, as they appear in the drawings, as follows:

(1) Flash guard attached to main barrel to prevent any blow back leakage through the vent barrel seals from injuring the operator.

(2) Vent barrel rear support bushing, gas seal and retainer ring.

(3) Vent barrel locking and release mechanism.

(4) Main barrel vents into vent or exhaust barrel.

(5) Optional front pressure brake vents.

(6) Main or pressure barrel.

(7) Vent or exhaust barrel. This slides front and back to open and close the vents in the main barrel. Illustration shows fully to the rear with all vents open for minimum projectile velocity.

The variable velocity firearm operates by allowing the operator to either manually or automatically vent-off in various selected amounts, the explosive gasses which propel the projectile down the barrel of the gun. This firearm has numerous vents or exhaust holes in the main barrel immediately in front of the projectile, which the operator can open or close in varying amounts at will before firing each shot. With all sets of vents open, the weapon will exhaust or vent much of the gas pressure driving th projectile, thus rendering the weapon non lethal at a distance of ten yards from the target. With ten sets of vents in the main barrel, each set of vents which were opened or closed will increase or decrease the amount of gas available to propel the projectile. With ten vents closed, the weapon achieves full velocity; with eight vents closed, reduced velocity; with six vents closed, further reduced velocity, and so on, until having all vents open substantially reduces projectile velocity by dumping gas out an exhaust or vent barrel concentrically built around the main barrel. While vents exist in firearm technology, none are selectively controllable on a shot-by-shot basis by the user for the purpose of controlling projectile lethality. While the foregoing examples show specific applications of the principals of the invention, it will be appreciated that many variations can be made without departing from the scope of the invention. Accordingly, I intend to be bound only by the following claims.

I claim:

1. A firearm barrel comprising a breech end, a muzzel end, and means for controling a velocity of a discharging projectile comprising;

a first set of gas vents extending longitudinally along a portion of said breech end, a second set of gas vents extending longitudinally along a portion of said muzzle end, and a sliding, concentric sleeve having a longitudinal gas passage extending proximate said breech end and said muzzle end, said sleeve having a first gas sealing surface proximate said first set of gas vents and a second gas sealing surface proximate said muzzle end whereby longitudinally sliding said concentric sleeve along said barrel toward said breech end progressively exposes said first set of gas vents to decrease said velocity of said projectile by allowing gas to escape out said first set of gas vents down said longitudinal gas passage and out said second set of gas vents thereby bypassing said porjectile.

2. The barrel of claim 1 wherein a flashguard is attached to said breech end to prevent blowback leakage through said first gas sealing surface from injuring an operator.

3. The barrel of claim 1 wherein said sliding, concentric sleeve is maintained in a desired position and moved to a new position by a locking and release mechanism.

4. The barrel of claim 1 wherein said sliding, concentric sleeve is supported by a bushing at said breech end and held in place by a retaining ring.

* * * * *